US007459891B2

(12) United States Patent
Al-Shyoukh et al.

(10) Patent No.: US 7,459,891 B2
(45) Date of Patent: Dec. 2, 2008

(54) SOFT-START CIRCUIT AND METHOD FOR LOW-DROPOUT VOLTAGE REGULATORS

(75) Inventors: Mohammad A. Al-Shyoukh, Richardson, TX (US); Marcus M Martins, Richardson, TX (US); Devrim Yilmaz Aksin, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 61 days.

(21) Appl. No.: 11/683,074

(22) Filed: Mar. 7, 2007

(65) Prior Publication Data

US 2007/0216383 A1 Sep. 20, 2007

Related U.S. Application Data

(60) Provisional application No. 60/782,643, filed on Mar. 15, 2006.

(51) Int. Cl.
*G05F 1/565* (2006.01)
*G05F 1/575* (2006.01)

(52) U.S. Cl. ..... 323/274; 323/275; 323/901; 323/908

(58) Field of Classification Search ..... 323/273, 323/274, 275, 276, 277, 281, 311, 312, 349, 323/901, 908

See application file for complete search history.

(56) References Cited

U.S. PATENT DOCUMENTS

| | | | | |
|---|---|---|---|---|
| 6,445,167 | B1 * | 9/2002 | Marty | 323/280 |
| 6,580,257 | B2 * | 6/2003 | Marty | 323/280 |
| 6,822,428 | B2 * | 11/2004 | Miyanaga et al. | 323/284 |
| 7,274,176 | B2 * | 9/2007 | Mihara | 323/269 |
| 7,397,226 | B1 * | 7/2008 | Mannama et al. | 323/273 |
| 7,402,987 | B2 * | 7/2008 | Lopata | 323/282 |

OTHER PUBLICATIONS

Gabriel A. Ricin-Mora and Phillip E. Allen; A Low-Voltage, Low Quiescent Current, Low Drop-Out Regulator; IEEE Journal of Solid-State Circuits, vol. 33, No. 1, Jan. 1998.

* cited by examiner

*Primary Examiner*—Gary L Laxton
(74) *Attorney, Agent, or Firm*—Warren L. Franz; Wade J. Brady, III; Frederick J. Telecky, Jr.

(57) ABSTRACT

A low drop-out voltage regulator having soft-start. A low drop-out regulator circuit is provided having an input node, an output node, a power FET connected by a source and drain between the input node and the output node, and a feedback circuit having an output connected and providing a control signal to a gate of the power FET. A current limit circuit is configured to control the power FET to limit the current through it when the voltage across a controllable sense resistor connected to conduct a current representing the current through the power FET exceeds a predetermined limit value. At start-up, control unit provides a control signal to the controllable resistor to cause the resistance value of the controllable resistor to decrease incrementally in value at respective predetermined incremental times during a predetermined time interval.

10 Claims, 2 Drawing Sheets

SOFT-START CIRCUIT AND METHOD FOR LOW-DROPOUT VOLTAGE REGULATORS

CROSS-REFERENCE TO RELATED APPLICATIONS

This application claims the benefit of priority of the U.S. Patent Application Ser. No. 60/782,643, filed Mar. 15, 2006.

TECHNICAL FIELD OF THE INVENTION

The present invention relates to low dropout voltage regulators having current limiting.

BACKGROUND OF THE INVENTION

A widely used type of linear voltage regulators is the low dropout ("LDO") voltage regulator. Dropout voltage is the term used to describe the minimum voltage across a regulator that is required to maintain output voltage regulation. LDO voltage regulators are widely used in modern low voltage (battery) power management integrated circuits ("ICs") since they maximize the utilization of the available input voltage and can operate with higher efficiency than other types of voltage regulators.

Typical applications usually require that the LDO voltage regulator start as quickly as possible upon enable. Recently, however, many IC customers are demanding LDO voltage regulators with so-called "soft-start" capability, by which it is meant that the regulator output is slowly ramped to the desired final regulated voltage upon enable. This is primarily done so as to limit inrush current at initialization. This demand has risen especially with the widespread use of the Universal Serial Bus ("USB"). The USB standard imposes a stringent limit on the amount of current the USB power bus can source. If, during any mode of operation an LDO voltage regulator has to pull its current directly from the USB bus during startup, a major inrush current can flow through the regulator which exceeds the maximum current the USB bus can handle. Such an inrush of current can easily cause the system to malfunction, or cause an undesirable reset. This is so even if the full load current of the LDO regulator during steady-state operation is less than the maximum current the USB bus can handle, because during start-up, large current transients can occur, thus causing overload of the bus.

FIG. 1 is a block diagram showing the way in which modern power management ICs connect LDO regulators to a USB bus. Each of the N bus lines has its own separate LDO regulator circuit, and each such regulator circuit is susceptible to large inrush currents upon enable.

One of the more popular and simpler prior art ways of achieving soft-start is by slowly ramping up the reference voltage from which the LDO regulator derives its output voltage upon enable. This can be achieved by using a resistor-capacitor ("RC") circuit branch to slow down the rising of the voltage reference at enable, or by other means. An LDO voltage regulator includes an error amplifier. By applying a slowly rising reference to the error amplifier, any large signal response that could potentially cause a major inrush of current is reduced. This method, while successful in many cases, can still fail for certain start-up conditions in which a sudden switching of load current through the LDO voltage regulator may still be activated.

SUMMARY OF THE INVENTION

The present invention provides a low drop-out voltage regulator having closed-loop-controlled soft-start. A low drop-out regulator circuit is provided having an input node, an output node, a power FET connected by a source and drain between the input node and the output node, and a feedback circuit having an output connected and providing a control signal to a gate of the power FET. A current limit circuit is configured to control the power FET to limit the current through it when the voltage across a controllable sense resistor connected to conduct a current representing the current through the power FET exceeds a predetermined limit value. At start-up, control unit provides a control signal to the controllable resistor to cause the resistance value of the controllable resistor to be high during a predetermined time interval, and then gradually reduced through pre-determined and subsequent time intervals.

In one embodiment, a power FET is connected by its source and a drain between an input node for receiving an input voltage and an output node for providing an output voltage. A feedback loop is configured to compare a voltage representing the output voltage to a first reference voltage and provide an output signal representing the gained difference between them to a gate of the power FET. A controllable sense resistor has a first terminal connected to the input node. A sense FET is connected by its source and a drain between a second terminal of the controllable sense resistor and the output node, and is connected to receive at a gate the output signal of the feedback loop. A current-limit amplifier has a first input connected to the connection node of the controllable sense resistor and the sense FET and a second input connected to receive a second reference voltage representing a current limit threshold, and having an output for providing an output signal when the voltage at the connection node of the controllable sense resistor and the sense FET goes below the second reference voltage. A limit FET is connected by its source and a drain between the input node and the output of the feedback loop and having a gate connected to the output of the current-limit amplifier. A digital control unit provides, at start-up, a control signal to the controllable resistor to cause the resistance value of the controllable resistor to be high over a predetermined time value and then gradually lowered through predetermined and subsequent time values.

Prior art voltage-based techniques for soft-start only allow open loop control of the input voltage (i.e. no closed-loop monitoring of the current through the power FET). But, the invention provides a closed-loop current-limit-based positively-controlled increase in the output voltage during start-up. In some embodiments of the invention, the profile of the soft-start may be programmably controlled in the digital domain, providing easily customizable control of soft-start by the designer. The invention may be implemented with minimal die area and thus is a very cost-effective solution.

These and other aspects and features of the invention will be apparent to those skilled in the art from the following detailed description of the invention, taken together with the accompanying drawings.

DETAILED DESCRIPTION OF THE PREFERRED EMBODIMENT

The making and use of the various embodiments are discussed below in detail. However, it should be appreciated that the present invention provides many applicable inventive concepts which can be embodied in a wide variety of specific contexts. The specific embodiments discussed are merely illustrative of specific ways to make and use the invention, and do not limit the scope of the invention.

As mentioned above, prior art LDO voltage regulators with soft-start circuitry can still cause problems for certain start-up conditions in which a sudden switching of load current from the LDO voltage regulator through its power FET is activated. The invention provides a solution by providing a soft-start that ensures that the transient current during start-up never exceeds a certain value. Some embodiments of the invention have the further improvement of providing the versatility of programming different start-up profiles as demanded by the application or customers. This enables a designer incorporating such an LDO regulator to easily program different soft-start profiles while using the exact same hardware as the application changes.

Figure 1:
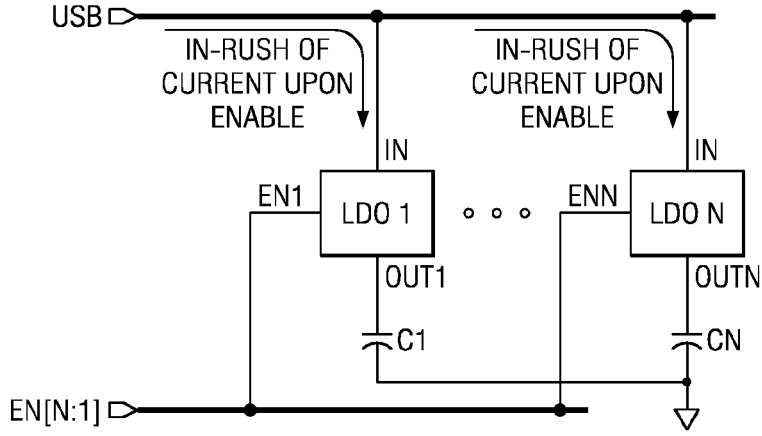
FIG. 1 (PRIOR ART)
FIG. 1 is a block diagram showing a technique for powering LDO regulators from a USB bus.
Figure 2:
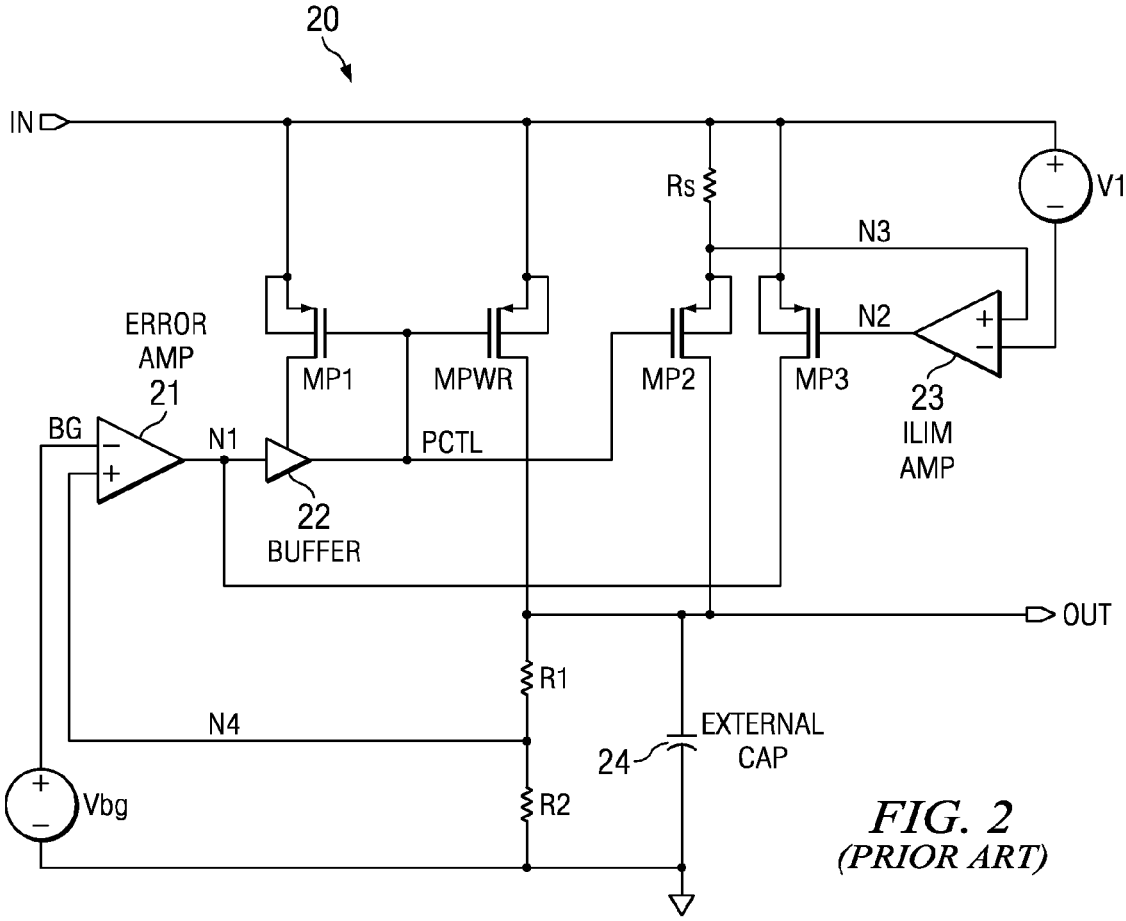
FIG. 2 (PRIOR ART)
FIG. 2 is a circuit diagram of a typical prior art LDO regulator having current limiting.

While the inventive principles are applicable to a wide variety of LDO regulator topologies, to enable better understanding of the invention and the embodiments described herein, one typical prior art LDO voltage regulator with current limiting capability will be described by way of background. FIG. 2 is a circuit diagram showing such a regulator 20. A discussion of principles of operation of such a regulator can be found, for example, in "*A Low-Voltage, Low Quiescent Current, Low Drop-Out Regulator*," by Gabriel Rincon-Mora et al., IEEE Journal of Solid State Circuit, vol. 33, pp. 36-44, January 1998. Briefly, the regulator 20 includes an error amplifier 21 and a unity gain dynamically biased buffer 22 having its input connected to a node N1, which is the output of the error amplifier 21. A dynamic bias, positive-type field effect transistor ("PFET") MP1 has its source connected to a power rail IN providing an input voltage Vin, and has its drain connected to the bias input of buffer 22. A sense FET, PFET MP2, is connected by its drain in series through a sense resistor Rs to power rail IN, in parallel with a power FET MPWR, which has its source connected directly to power rail IN. The gates of power FET MPWR, dynamic bias PFET MP1 and sense FET MP2 are connected to the output of buffer 22, node PCTL. The drains of both the power FET MPWR and the sense FET MP2 are connected to the output node OUT. Connected between node OUT and ground are an external load capacitor 24 and a resistive divider comprised of resistor R1 and R2 connected in series. The common connection node N4 of the resistive divider is connected to the non-inverting input of amplifier 21. The inverting input of amplifier 21 is connected to node BG which is the output of a bandgap reference voltage circuit Vbg providing a bandgap voltage Vbg. The common connection node N3 of sense resistor Rs and sense FET MP2 is connected to the non-inverting input of a current-limit amplifier 23. The output of amplifier 23 is connected to the gate of a clamping current-limit PFET MP3 which has its source connected to power rail IN and its drain connected to node N1. The inverting input of amplifier 23 is connected to a reference voltage source V1 providing a reference voltage V1 which sets the desired threshold value for the current limit.

In general, the voltage on node N4, a divided version of the output voltage Vout on node OUT, is provided as feedback to error amplifier 21 where it is compared against Vbg. The buffered and amplified error signal on node PCTL controls power FET MPWR to maintain a regulated Vout under varying load conditions, with the only drop in voltage between Vin and Vout being the small source-drain drop across power FET MPWR.

As mentioned above, sense FET MP2, is connected in parallel with power FET MPWR, and has its gate controlled by the same node PCTL controlling power FET MPWR. Thus, as the current provided by the power FET MPWR increases, the current through sense FET MP2 also increases. This causes the voltage on node N3 to decrease, as the current through sense resistor Rs increases. The voltage at node N3 is compared in amplifier 23 to reference voltage V1, which sets the current limit. Thus, if the voltage at node N3 goes below V1, the output of amplifier 23, i.e., at node N2, goes low. This turns current-limit PFET MP3 ON, thus pulling up on node N1, holding it at its value and preventing it from going down any further, thereby preventing the power FET MPWR from being turned ON any harder by error amplifier 21. This holds the output current at the current limit level $I_{lim}$. Thus, current is prevented from being sourced from the LDO regulator 20 that is any greater than $I_{lim}$.

Figure 3:
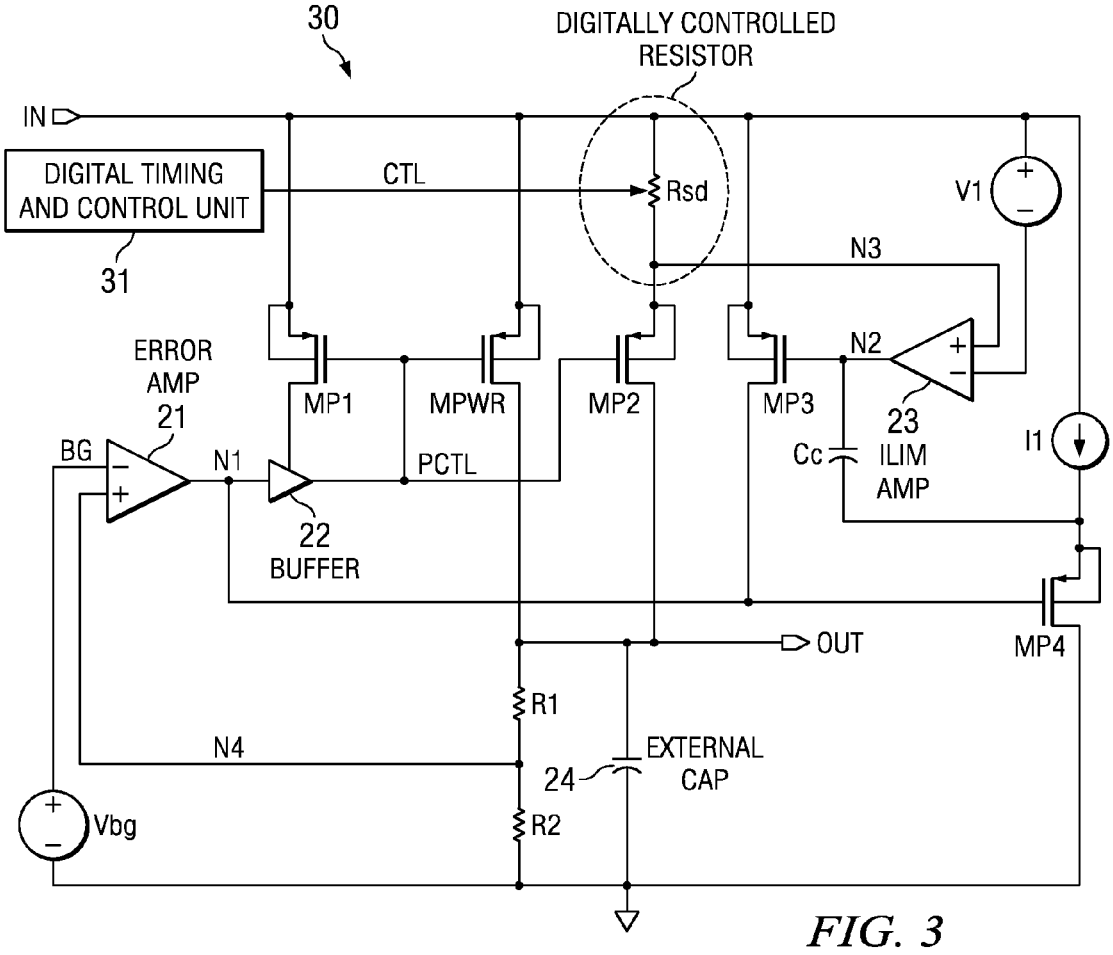
FIG. 3 is a circuit diagram of a preferred embodiment of an LDO regulator implementing the invention.

In accordance with the principles of the present invention, current limit circuitry of an LDO regulator enables a slow charging of an external load capacitor, while precisely controlling the current that is sourced from the LDO regulator during startup conditions. FIG. 3 is a circuit diagram of a preferred embodiment LDO regulator 30 of the invention. LDO regulator 30 includes some of the same components as in LDO regulator 20 of FIG. 2, and those components are given the same reference characters in FIG. 3. To the extent that their operation is the same as in regulator 20 description of such operation is not repeated here.

It can be seen in regulator 30 that the sense resistor Rs of FIG. 2 is replaced by a digitally-programmable variable ("DPV") resistor Rsd. This resistor is controlled by a digital timing and control ("DTC") unit 31 which is activated at startup. DTC unit 31 may be implemented as a simple state machine that gradually reduces the value of DPV resistor Rsd over time following initiation of startup. Reducing the value of DPV resistor Rsd in steps increases the current limit $I_{lim}$ in corresponding steps, thereby providing a gradually increasing current limit. For example, the startup time may be divided into intervals $t_1, t_2, \ldots t_n$, during which the external capacitor is charged at maximum values of $I_{lim1}, I_{lim2}, \ldots I_{limn}$. The final limit $I_{limn}$ can serve as the desired current limit value during steady-state operation of the regulator 30 after startup finishes. The intervals $t_1, t_2, \ldots t_n$, are set by the digital control unit, which enables the creation of both precise and easily programmable soft-start profiles by the designer.

In accordance with another aspect of the invention a compensation scheme where by the main regulation loop and the current-limit loop are totally decoupled from one another is utilized here. It is particularly difficult to stabilize both the current limit loop and the main regulation loop for one current limiting value $I_{lim}$ let alone a whole range of values $I_{lim1}$, $I_{lim2}, \ldots I_{limn}$, and without such compensation it is not possible to ensure stability of the LDO regulator at all load current values and at all programmed $I_{lim}$ values $I_{lim1}$, $I_{lim2}, \ldots I_{limn}$. This compensation is realized in the embodiment shown in FIG. 3 by a compensation capacitor Cc, and a voltage follower stage realized by PFET MP4 and current source I1. The drain of PFET MP4 is connected to ground and its gate is connected to the output of amplifier 21. Current source I1 is connected between input power rail IN and the source of PFET MP4, while compensation capacitor Cc is connected between the output of current limit amplifier 23 and the source of PFET MP4. The voltage follower structure re-creates the small signal present at node N1 at the source terminal of PFET MP4 thereby eliminating the need to connect compensation capacitor Cc to N1 in a classical Miller compensation fashion and thus preventing the loading of the main regulation loop by the typically large compensation capacitor Cc required to stabilize the current limit loop. More information on the compensation technique used here to decouple the main regulation loop from the current limit loop can be found in a commonly assigned co-pending U.S. patent application Ser. No. 10/805,812 of Raul A. Perez, filed on Mar. 22, 2005, and incorporated herein by reference.

Figure 4:
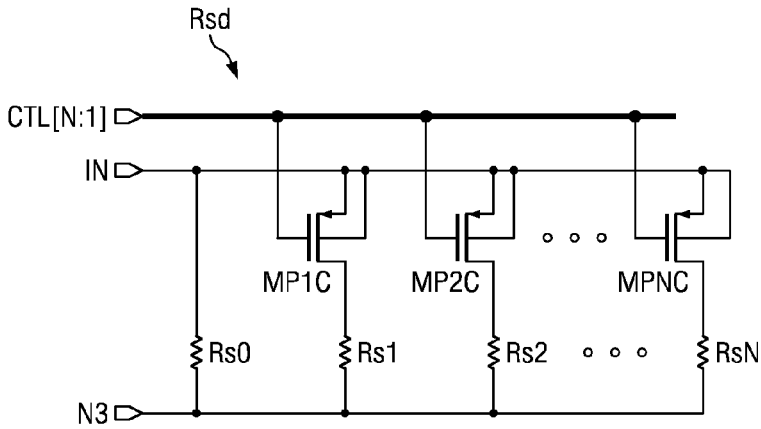
FIG. 4 is a circuit diagram of the digitally controlled resistor of FIG. 3.

FIG. 4 is a circuit diagram showing a preferred embodiment of the digitally-programmable variable ("DPV") resistor Rsd. A resistor Rs0 is connected between power rail IN and node N3. In addition, a plurality of further resistors Rs1, Rs2, . . . RsN, is provided, each such resistor being connected in series with an associated PFET MP1C, MP2C, . . . MPNC, respectively, by the PFET's source and drain, between power rail IN and node N3. The gates of PFETs MP1C, MP2C, . . . MPNC, are each connected to a respective one of N lines of N-wide control signal CTL[N:1]. Immediately after startup begins, PFETs MP1C, MP2C, . . . MPNC, are all OFF, and DPV resistor Rsd is equal to Rs0. After interval $t_1$ passes, PFET MP1C is turned ON, and the value of DPV resistor Rsd becomes Rs0 in parallel with Rs1, i.e., Rs0 || Rs1. The PFETs MP1C, MP2C, . . . MPNC, are turned ON in sequence, interval by interval, $t_1, t_2, \ldots t_n$, and at time $t=t_n$, the value of DPV resistor Rsd is equal to Rs0 || Rs1 || . . . RsN.

In accordance with an aspect of the invention the duration of time intervals $t_1, t_2, \ldots t_n$ can be stored and totally customized in the digital domain thus enabling programmable and customizable soft-start profiles. This enables easy adjustment by the designer of the soft-start according to varying application needs, external load capacitors, or customer requirements.

Although the present invention and its advantages have been described in detail, it should be understood that various changes, substitutions and alterations can be made herein without departing from the spirit and scope of the invention as defined by the appended claims.

What is claimed is:

1. A low drop-out voltage regulator, comprising:

a low drop-out regulator circuit having an input node, an output node, a power FET connected by a source and drain between the input node and the output node, and a feedback circuit having an output connected and providing a control signal to a gate of the power FET;

a current limit circuit configured to control the power FET to limit the current therethrough when the voltage across a controllable sense resistor connected to conduct a current representing the current through the power FET exceeds a predetermined limit value; and a control unit adapted to provide, at start-up, a control signal to the controllable resistor to cause the resistance value of the controllable resistor to decrease incrementally during a predetermined time interval.

2. A low drop-out voltage regulator according to claim 1 wherein the controllable resistor comprises a plurality of resistors that are configured to be connected in parallel in selectable numbers under control of the control signal.

3. A low drop-out voltage regulator according to claim 2, wherein:

the controllable resistor comprises the plurality of resistors each connected in series with a respective switch to thereby comprise a plurality of switch-resistor branches, with the plurality of resistor-switch branches being connected in parallel.

4. A low drop-out voltage regulator according to claim 2 wherein the controllable resistor further comprises a fixed resistor connected in parallel with the plurality of resistor-switch branches.

5. A low drop-out voltage regulator according to claim 1 wherein the control unit is configured to provide a control signal that controls the controllable resistor to decrease incrementally in value during the predetermined time interval.

6. A low drop-out voltage regulator according to claim 5 wherein the control unit is configured to provide a control signal that controls the controllable resistor to decrease incrementally in value at respective predetermined incremental times during the predetermined time interval.

7. A low drop-out voltage regulator according to claim 1, wherein:

the low drop-out regulator circuit comprises an error amplifier configured to provide an output corresponding to the difference between a first reference voltage and a feedback voltage, a buffer amplifier receiving at an input the error amplifier output and providing at an output a power FET control signal, a feedback circuit configured to sense the voltage at the output node and to provide the feedback voltage at a level corresponding to the voltage at the output node; and the current limit circuit comprises a sense FET connected by a source and a drain between one terminal of the controllable sense resistor, the other terminal of the sense resistor being connected to the input node, and the output node, a gate of the sense FET being connected to receive the power FET control signal, a current-limit amplifier having a first input connected to the common connection node of the sense resistor and the sense FET and having a second input connected to a second reference voltage, configured to provide at an output a voltage representing the difference between the voltages at the first and second inputs, and a current-limit FET connected by a source and drain between the input of the buffer amplifier and the input node, a gate of the current-limit FET being connected to the output of the current-limit amplifier.

8. A low drop-out voltage regulator according to claim 7 further comprising:

a voltage-follower stage comprising a current source connected to the input node and providing a current at an output thereof, and a voltage-follower FET connected by a source and a drain between the current source output and ground, a gate of the voltage-follower FET being connected to the input of the buffer amplifier, and a capacitor connected between the common connection node of the current source and the voltage-follower FET and the output of the current-limit amplifier.

9. A low drop-out voltage regulator, comprising:

a power FET connected by a source and a drain between an input node for receiving an input voltage and an output node for providing an output voltage;

a feedback loop configured to compare a voltage representing the output voltage to a first reference voltage and provide an output signal representing the difference between them to a gate of the power FET;

a controllable sense resistor having a first terminal connected to the input node;

a sense FET connected by a source and a drain between a second terminal of the controllable sense resistor and the output node, and connected to receive at a gate the output signal of the feedback loop;

a current limit amplifier having a first input connected to the connection node of the controllable sense resistor and the sense FET and a second input connected to receive a second reference voltage representing a current limit, and having an output for providing an output signal when the voltage at the connection node of the controllable sense resistor and the sense FET goes below the second reference voltage;

a limit FET connected by a source and a drain between the input node and the output of the feedback loop and having a gate connected to the output of the current limit amplifier; and a control unit adapted to provide, at start-up, a control signal to the controllable resistor to cause the resistance value of the controllable resistor to decrease over a predetermined time to a final value.

10. A method for soft start in a low drop-out voltage regulator comprising an input node, an output node, a power FET connected by a source and drain between the input node and the output node, and a feedback circuit having an output connected and providing a control signal to a gate of the power FET, comprising the steps of:

controlling the power FET to limit the current therethrough when the voltage across a controllable sense resistor connected to conduct a current representing the current through the power FET exceeds a predetermined limit value; and providing, at start-up, a control signal to the controllable resistor to cause the resistance value of the controllable resistor to decrease incrementally in value at respective predetermined incremental times during a predetermined time interval.

* * * * *